United States Patent [19]

Hornabrook

[11] 4,431,338

[45] Feb. 14, 1984

[54] IRRIGATION MONITORING SYSTEM

[76] Inventor: Graham A. Hornabrook, 30 Hazelwood Dr., Dubbo, New South Wales, 2830, Australia

[21] Appl. No.: 238,415

[22] Filed: Feb. 26, 1981

[51] Int. Cl.[3] ..... E02B 13/00; E02B 11/00

[52] U.S. Cl. ..... 405/37; 405/36; 405/92

[58] Field of Search ..... 405/36–38, 405/92, 115

[56] References Cited

U.S. PATENT DOCUMENTS

| | | | |
|---|---|---|---|
| 1,758,941 | 5/1930 | Gibson | 405/37 |
| 3,114,243 | 12/1963 | Winters | 405/37 |
| 3,372,549 | 3/1968 | French | 405/92 |
| 3,408,818 | 11/1968 | Hemphill | 405/37 |
| 3,426,539 | 2/1969 | Whear | 405/37 |
| 3,797,253 | 3/1974 | Rodieck | 405/37 |
| 4,167,358 | 9/1979 | Besha | 405/115 X |

*Primary Examiner*—Dennis L. Taylor

*Attorney, Agent, or Firm*—Emory L. Groff, Jr.

[57] ABSTRACT

An irrigation system in which a main channel is connected to a series of irrigation bays by separate distribution channels and the flow of water to each bay is controlled centrally in response to the moisture content in each bay. The bays are irrigated in sequence by a central control system.

2 Claims, 1 Drawing Figure

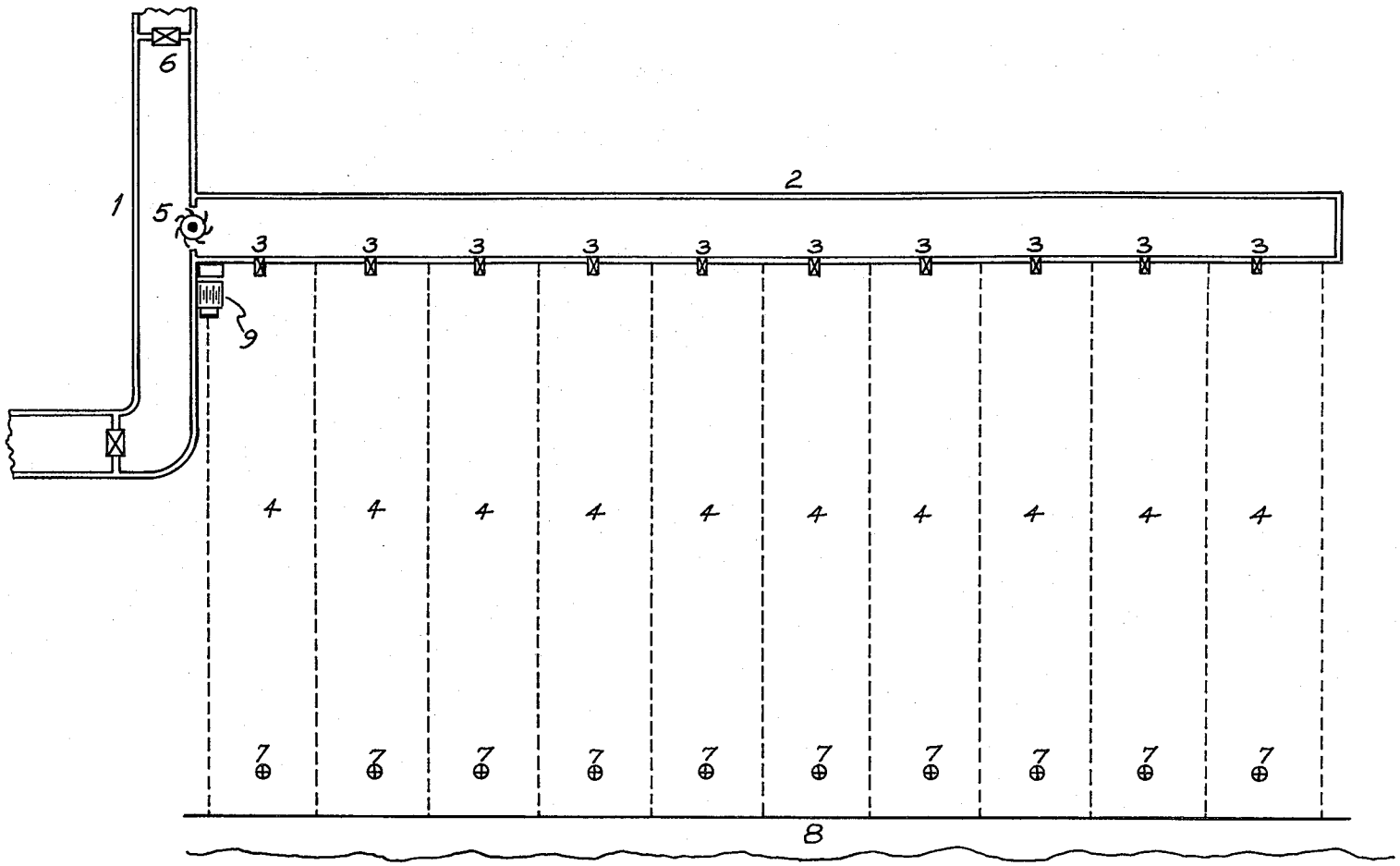
1
2
3
4
5
6
7
8
9

IRRIGATION MONITORING SYSTEM

BACKGROUND OF THE INVENTION

This invention relates to a system of irrigation which allows the watering of a large land area to be automatically and constantly monitored and controlled. Hitherto the control of irrigation has been a matter for visual inspection and the subsequent interruption of the water supply from which irrigation is taking place; i.e. a flood gate, turn cock or spray system. This process is obviously time consuming and unreliable, requires the employment of intermittent labour and is very much subject to human error.

OBJECT OF THE INVENTION

One of the objects of this invention is to provide a fully automatic system whereby the irrigation of a land area is both monitored and controlled to the extent that the need for employed labour is eliminated. It is a further object of the invention to achieve this at minimum installation and operating costs.

SUMMARY OF THE INVENTION

In one form the irrigation system of this invention comprises a main channel running the length of the area to be irrigated and having one or more outlets to one or more irrigation bays, wherein flow control means for opening and closing of an individual outlet is controlled by signals emanating from a central control.

The invention also provides an irrigation system for irrigating a plurality of irrigation bays, said system including a main channel or line having a supply of water, a separate distribution channel or line connecting each bay to the main channel, flow control means for each distribution channel operative to initiate and cease the flow of water to its irrigation bay, sensing means in each bay for sensing a pre-determined moisture content at a pre-selected location in each bay and control means operative to activate each flow control means in sequence so as to initiate flow of water to each bay in sequence and operative to de-activate each flow control means in response to a signal received from the sensing means indicating that the pre-determined moisture content in that bay has been reached.

DESCRIPTION OF THE DRAWING

The FIGURE of the drawing is a schematic view of the invention showing the general features thereof.

DESCRIPTION OF PREFERRED EMBODIMENT

A preferred irrigation system according to the invention will now be described with reference to the accompanying drawing which shows, in plan, the irrigation area. A main supply channel 1 feeds a main irrigation channel 2. Both these channels are formed by earth banks and the banks of the latter channel have a series of distribution channels in the form of pipe openings 3 at their base which allow the flow of water from this channel into irrigation bays 4. Each of these pipes contains a rubber inflatable bag which is fixed to the pipe and free to expand thus closing off the pipe.

Each of the inflatable bags has a stem opening which passes through a hole in the pipe wall from the fixed section of the bag. Each of these stems is connected to a pressure line from a central air compressor via a three way valve. These valves are operable by a battery energised solenoid between an open position in which the bag is kept inflated by pressure from the pressure line and a closed position in which the pressure line is closed off and air is allowed to escape from the bag.

The opening of these types of irrigation bays is controlled by a central radio transmitter 9 which can be programmed to carry out the whole irrigation cycle. At the beginning of a cycle the feed gate 6 to the main irrigation channel is opened to allow the entry of water, the pipes 3 to the irrigation bays 4 being kept closed by the inflated rubber bags. The central control then transmits signals which are received by the valve solenoid unit attached to the pipe leading to the first bay. Upon receipt of the signal the solenoid closes the valve, the bag deflates and water flows from the main irrigation channel into the bay.

There is a series of sensors 7 at the tail drain end 8 of the bays. Each sensor could consist of a photoelectric beam unit which is interrupted when the water saturates the ground at the end of the bay. However, it is preferred that each sensor operates on the capacitance principle and therefor includes two metal probes embedded in the soil so that the capacitance varies according to the water content of the soil between the probes.

When the water content reaches a predetermined level and as a consequence the capacitance of the probes reaches a predetermined value, a radio transmitter at the sensor is actuated to transmit a coded signal back to the central control which then transmits signals to activate the solenoid cell of the bag in the pipe leading to the second bay and to close the bag in the first bay.

Similarly, when the sensor at the end of the second bay sensors the predetermined water content and transmits its coded signal to central control, signals are transmitted to activate the flow into the third bay and to close off the flow to the second bay and so on until all the bays associated with the main irrigation channel have been irrigated. The signal from the final bay sensor causes a central control to shut the pipe 5 thus shutting off the supply of water to the irrigation channel so that it is available for other channels.

Alternatively, the opening and closing of the pipes to the bays can be programmed to occur at spaced time intervals and be independent of the sensors. The latter can, however, be adjusted to trigger a warning alarm in the event that the outlet to a bay fails to close and flooding occurs. Power for the whole system can be supplied by a water driven generator 5 (and air compressor if required) which keeps storage batteries at the central control charged and the airline charges with compressed air.

The radio transmitter associated with each individual sensor transmits a signal which is characterised as being uniquely associated with the sensor from which it is radiated. This characterisation may be represented in terms of either carrier frequency or modulation. Thus, each point at which a sensor is located is identifiable by the particular radio signal transmitted therefrom.

A radio receiver is located at the central monitoring or control station for receiving the signals transmitted from each of the sensors. Translation of the signals after reception according to their particular characterisation produces a plurality of signals representative of the irrigation progress at each point at which a sensor is located across the land area being watered. At this stage, the signals may be monitored by means of some form of visual indicator, such as a meter, indicator lamp etc. Each signal is then used to control electromechanically the supply of water to the point on the land area of which each signal is representative.

The characterisation of the control signals associated with each sensor may be manifested by discrete differences in the carrier frequencies of the transmitted signals or by coded modulation thereof. For the purpose of the latter, any well known form of modulation may be employed (e.g., amplitude, frequency or pulse modulation) so that discrete differences between the modulating signals serve to distinguish individual sensors when the transmitted signals are received and demodulated. Each demodulated signal is then used to trigger an electromechanical water gate opening mechanism, solenoid valve or electrical pump. In the preferred arrangement, the absence of a signal associated with a particular sensor causes the supply of water to the area surrounding that sensor to be maintained and the presence of a signal associated with a particular sensor causes the supply of water to the area surrounding that sensor to be cut off. However, the system of the present invention may also be adapted so that the modulation of each transmitted signal is varied in accordance with degrees of irrigation to effect control of the water supply through incremental changes rather than a discrete on-off situation.

It will be immediately apparent that the scale of this system can be mulitplied to cover any given land area. It will also be apparent that the valved inflatable bag type closure means can be used to control the flow of water through all the pipes or gates of a whole system.

The gates can be conventional flood gates or inflatable envelope type gates which operate in a similar fashion to the inflatable bags of the pipe outlets.

Siphons could be used as the means for controlling flow of water to each bay with the control signals being arranged to actuate a control system therefor.

When an adequate source of water pressure is available this could be used to inflate the bags instead of an air compressor. Further a signal wire system could be used throughout the system instead of radio signals and different types of sensors could be used to indicate the saturation of water bays. These and other modifications are possible without departing from the basic system of this invention.

I claim:

1. An irrigation system for irrigating a plurality of irrigation bays, said system including a main channel having a supply of water, a separate distribution channel connecting each bay to the main channel, flow control means for each distribution channel operative to initiate and cease the flow of water to its irrigation bay, sensing means in each bay for sensing a pre-determined moisture content at a pre-selected location in each bay and central control means operative to activate each flow control means in sequence so as to initiate flow of water to each bay in sequence and operative to de-activate each flow control means in response to a signal received from the sensing means indicating that the pre-determined moisture content in that bay has been reached, each said sensing means including a radio transmitter transmitting a signal which is characterized as being uniquely associated with the sensor from which it is related, said characterization comprising amplitude, frequency or pulse modulation whereby each point at which a sensor is located is identifiable by the particular radio signal transmitted therefrom.

2. An irrigation system as claimed in claim 1 wherein the control means includes a programmable radio transmitter and receiver which broadcasts signals to a receiver at each flow control means, each receiver being operative to control the operation of its flow control means.

* * * * *